US008317419B2

(12) United States Patent
Kitamura et al.

(10) Patent No.: US 8,317,419 B2
(45) Date of Patent: Nov. 27, 2012

(54) CASSETTE FOR PRINTER WITH THERMAL HEAD CONTACT PORTION

(75) Inventors: Gen Kitamura, Kawasaki (JP); Hitoshi Nishitani, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 649 days.

(21) Appl. No.: 11/914,548

(22) PCT Filed: Mar. 9, 2007

(86) PCT No.: PCT/JP2007/055299

§ 371 (c)(1),
(2), (4) Date: Nov. 15, 2007

(87) PCT Pub. No.: WO2007/119387

PCT Pub. Date: Oct. 25, 2007

(65) Prior Publication Data

US 2009/0074497 A1 Mar. 19, 2009

(30) Foreign Application Priority Data

Mar. 15, 2006 (JP) ..... 2006-071126

(51) Int. Cl.
*B41J 17/32* (2006.01)
*B41J 2/325* (2006.01)
*B65H 1/04* (2006.01)

(52) U.S. Cl. ..... 400/120.16; 400/208; 400/624; 400/246; 347/197

(58) Field of Classification Search ..... 400/208, 400/120.16, 120.17, 624, 246
See application file for complete search history.

(56) References Cited

U.S. PATENT DOCUMENTS

| | | | | |
|---|---|---|---|---|
| 4,779,141 | A * | 10/1988 | Watanabe | 358/401 |
| 4,860,029 | A | 8/1989 | Iseda | 346/76 |
| 5,089,897 | A * | 2/1992 | Curley | 358/296 |
| 5,277,502 | A | 1/1994 | Kim | 400/196 |
| 2002/0031388 | A1 * | 3/2002 | Palmer et al. | 400/615.2 |

FOREIGN PATENT DOCUMENTS

| | | |
|---|---|---|
| EP | 904947 | 3/1999 |
| EP | 1099561 | 5/2001 |
| JP | 60-32678 | 2/1985 |
| JP | 8-112951 | 5/1996 |
| JP | 2005335292 A * | 12/2005 |
| JP | 2006062172 A * | 3/2006 |

OTHER PUBLICATIONS

International Search Report and Written Opinion from parent PCT Application No. PCT/JP2007/055299, dated Sep. 17, 2007.

* cited by examiner

*Primary Examiner* — Daniel J Colilla
(74) *Attorney, Agent, or Firm* — Fitzpatrick, Cella, Harper & Scinto

(57) ABSTRACT

An ink ribbon cassette is inserted into and removed from a thermal transfer printer in the longitudinal direction of the thermal head. The thermal head is provided with a lifting member, while the ink ribbon cassette is provided with a contact element. The lifting member and the contact element of the ink ribbon cassette are configured to be in contact with each other during insertion and removal of the ink ribbon cassette, and thereby lift the thermal head to widen the space for the ink sheet to pass through.

7 Claims, 12 Drawing Sheets

CASSETTE FOR PRINTER WITH THERMAL HEAD CONTACT PORTION

TECHNICAL FIELD

The present invention relates to a printer capable of transferring ink from an ink sheet to a recording sheet with a thermal head, and a cassette that can be inserted into, and removed from, the printer.

BACKGROUND ART

FIG. 1 is a schematic view illustrating a printing unit of a thermal transfer printer apparatus 1.

During printing, a thermal head 2 and a platen roller 3 are pressed against each other with a recording sheet 4 and an ink sheet 5 therebetween. A plurality of heating elements linearly arranged along the length of the thermal head 2 generate heat and thereby transfer ink on the ink sheet 5 onto the recording sheet 4, which, in turn, is conveyed by a recording sheet conveying mechanism that is positioned downstream of the conveying direction during printing, and the ink sheet 5 is conveyed by an ink sheet take-up mechanism. In synchronization with the conveyance of the recording sheet 4 and the ink sheet 5, the plurality of heating elements selectively generate heat to form an image. After ink is transferred, the recording sheet 4 and the ink sheet 5 are conveyed by their respective conveying mechanisms to the downstream of their conveying paths, which diverge in the middle. The recording sheet 4 is directed to a paper ejecting portion, and the ink sheet 5 is separated from the recording sheet 4 by a separating member 6 and taken up by a take-up bobbin 12. The separating member 6 is positioned near a diverging point at which the conveying paths diverge.

FIG. 2 is a perspective view illustrating a state wherein an ink ribbon cassette 7, into which the ink sheet 5 is stored, is inserted into, or removed from, a main body of the printer apparatus 1.

In a thermal transfer printer, such as the printer apparatus 1, the ink ribbon cassette 7 is inserted into, and removed from, the printer apparatus 1 along the length of the thermal head 2, through an opening 1*a* that is provided on one side of the main body of the printer apparatus 1. During insertion and removal of the ink ribbon cassette 7, the ink sheet 5 passes through a space between the thermal head 2 and the platen roller 3.

FIG. 3 illustrates a typical conventional printer with the above-described configuration. When an ink ribbon cassette 7 is inserted into, and removed from, a main body of a printer apparatus 1, a thermal head 2 is fully retracted from a platen roller 3, as illustrated. Given that doing so provides sufficient clearance between the thermal head 2 and the platen roller 3, an ink sheet 5 is prevented from coming into contact with the thermal head 2 or the platen roller 3. Jamming of the ink sheet 5 is thus prevented.

FIG. 4 illustrates another type of a conventional printer, such as that disclosed in Japanese Patent Laid-Open No. 08-112951. A printer apparatus 1 in FIG. 4 is configured such that a thermal head 2 is secured to a main body of the printer apparatus 1, and that a platen roller 3 is moved when an ink ribbon cassette 7 is inserted into, or removed from, the main body of the printer apparatus 1. Given that the platen roller 3 is retracted from the thermal head 2, sufficient clearance is provided between the thermal head 2 and the platen roller 3. Jamming of an ink sheet 5 is thus prevented.

Examples of methods for securing a thermal head to a printer main body include a method in which a thermal head is fixed as a cantilever. That is, in this method, the thermal head is supported at one end and left free at the other end. FIG. 5 is a cross-sectional view illustrating a printing mechanism of a printer apparatus 1 in which a thermal head 2 is secured to a main body of the printer apparatus 1 as a cantilever. Referring to FIG. 5, an opening 1*a* for insertion of an ink ribbon cassette (not shown) is provided on one side of the printer apparatus 1. During insertion and removal of the ink ribbon cassette, an ink sheet (not shown) passes through a space between the thermal head 2 and the opening 1*a*. During printing, a free end of the thermal head 2 is secured to a surface of a lid (not shown) for the opening 1*a*, the surface being adjacent to the printer apparatus 1. The lid for the opening 1*a* is provided with a hole, into which a supporting member 2*a* for the thermal head 2 is to be fitted. The supporting member 2*a* not only enables accurate positioning of the thermal head 2, but also supports the free end of the thermal head 2. Therefore, the thermal head 2 is fixed at both ends, like a simple beam, and can withstand contact pressure of a platen roller 3 during printing.

There is another printer in which a thermal head and a separating member, such as the separating member 6 of FIG. 1, are covered with a guiding member, such as that indicated by reference numeral 8 in FIG. 5, so that an ink sheet comes into contact with the guiding member, and is introduced into the printer without causing jamming. There is still another printer in which, to reduce the possibility of jamming, a separating member and a guiding member are integrally molded of resin material, so that these members are seamlessly joined together.

However, if the printer apparatus 1 is configured such that the thermal head 2 is moved, as illustrated in FIG. 3, it is necessary to allow space for the thermal head 2 to retract. Moreover, since the thermal head 2 moves back and forth between the retracting position and the printing position, it is necessary to control the position of the thermal head 2 with high precision when the thermal head 2 is at the printing position, so as not to affect printing performance. It is thus required to ensure positioning accuracy.

If the printer apparatus 1 is configured such that the platen roller 3 is moved, as illustrated in FIG. 4, there is no need for the thermal head 2 to retract. Therefore, once the thermal head 2 is secured to the main body of the printer apparatus 1 and the required mounting accuracy is achieved, the printing position of the thermal head 2 can be automatically set.

However, the above-described configuration, where the thermal head 2 is fixed, may cause other problems.

In the typical thermal transfer printer apparatus 1 illustrated in FIG. 1, the ink sheet 5 is conveyed along the conveying path, while being pulled toward the thermal head 2. In the printer apparatus 1 where the thermal head 2 retracts, as illustrated in FIG. 3, the thermal head 2 moves to a retracting position, which provides sufficient clearance between the thermal head 2 and the ink sheet 5. Therefore, when the ink ribbon cassette 7 is inserted into the main body of the printer apparatus 1, the ink sheet 5 can be prevented from coming into contact with the thermal head 2.

However, in the printer apparatus 1 where the platen roller 3 retracts, as illustrated in FIG. 4, the thermal head 2 is secured to the main body of the printer apparatus 1. Therefore, during insertion and removal of the ink ribbon cassette 7, the ink sheet 5 tends to come into contact with an end portion of the thermal head 2 or the separating member 6, thus causing jamming to occur.

It is possible to prevent jamming of the ink sheet by providing the guiding member 8, as illustrated in FIG. 5. However, since the ink sheet comes into contact with the guiding member 8 in this case, the surface of the ink sheet may be scratched, and printing quality may be affected.

Moreover, since the thermal head 2 of FIG. 5 is fixed as a cantilever, the ink ribbon cassette comes into contact with the thermal head 2 during insertion and removal, and thus causes the thermal head 2 to bend. This narrows the clearance between the thermal head 2 and the opening 1*a* for allowing the ink sheet to pass therethrough, and prevents smooth passage of the ink sheet, thus causing jamming to occur.

DISCLOSURE OF INVENTION

The present invention provides a printer and a cassette with reduced possibility of ink-sheet jamming during cassette insertion and removal.

According to an aspect of the present invention, a cassette can be inserted into, and removed from, a printer that is capable of transferring ink from an ink sheet to a recording sheet with a thermal head. The cassette is inserted into the printer in a longitudinal direction of the thermal head. The cassette includes a first bobbin around which the ink sheet is wound, a second bobbin for taking up the ink sheet drawn from the first bobbin, and a housing configured to support the first bobbin and the second bobbin. The housing is provided with a contact portion that comes into contact with a contact member for the thermal head when the cassette is inserted into the printer, allowing the thermal head to move away from the ink sheet.

As described above, when the cassette is inserted into the printer, the contact portion of the cassette comes into contact with the contact member for the thermal head, and thereby moves the thermal head to separate from the ink sheet. Therefore, it is possible to prevent the thermal head and the ink sheet from coming into contact with each other. Thus, the printer can be protected from being jammed by the ink sheet, and the ink sheet can be protected from being scratched.

Moreover, since it is not necessary to move the thermal head when the cassette is inserted into the printer, the thermal head can be secured to the printer, ensuring the positional accuracy of the thermal head during printing.

Further features of the present invention will become apparent from the following description of exemplary embodiments with reference to the attached drawings.

BEST MODE FOR CARRYING OUT THE INVENTION

Exemplary embodiments of the present invention will now be described in detail with reference to the drawings.

First Exemplary Embodiment

Figure 1:
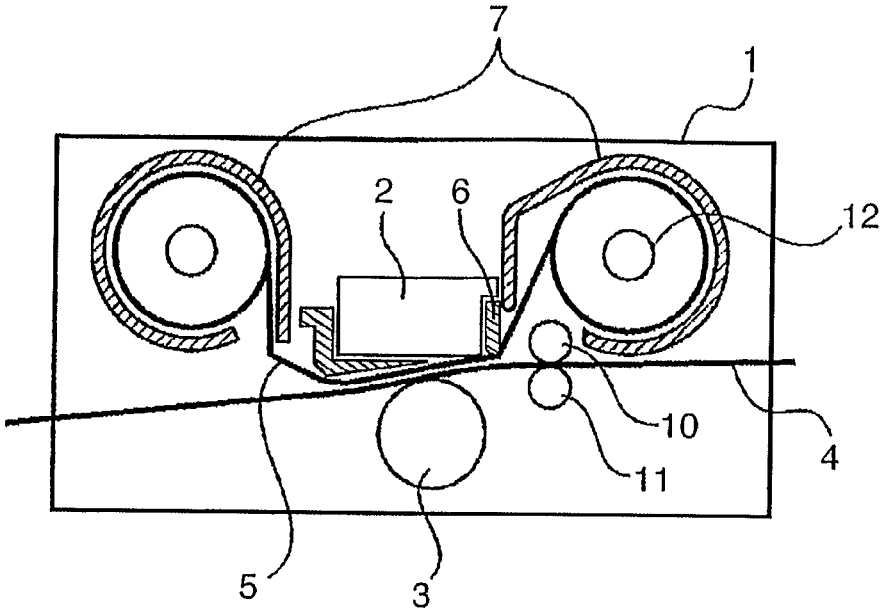
FIG. 1 PRIOR ART
FIG. 1 is a schematic cross-sectional view illustrating an overall configuration of a known printer apparatus and ink ribbon cassette.
Figure 2:
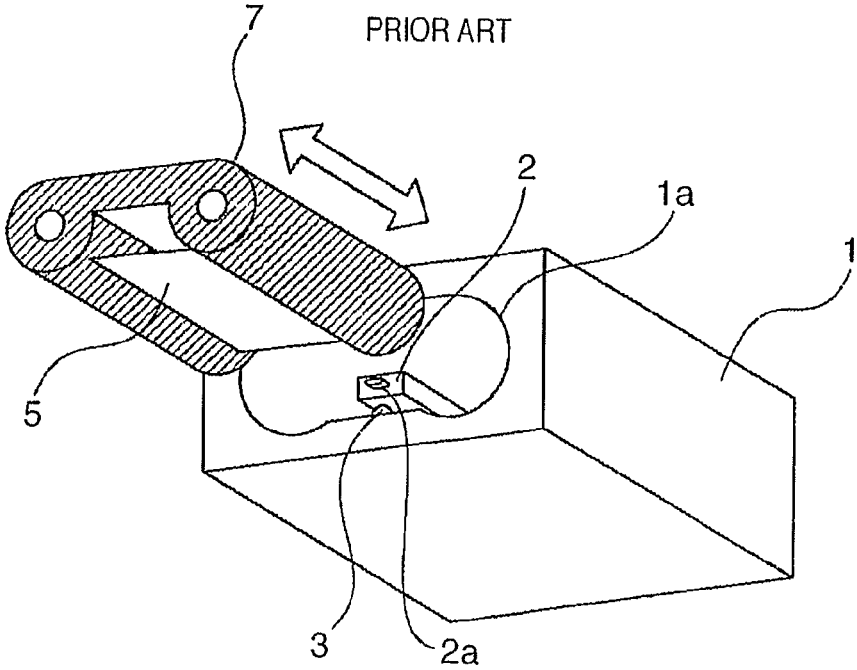
FIG. 2 PRIOR ART
FIG. 2 is a schematic perspective view illustrating a state in which the known ink ribbon cassette is inserted into, or removed, from the known printer apparatus.
Figure 3:
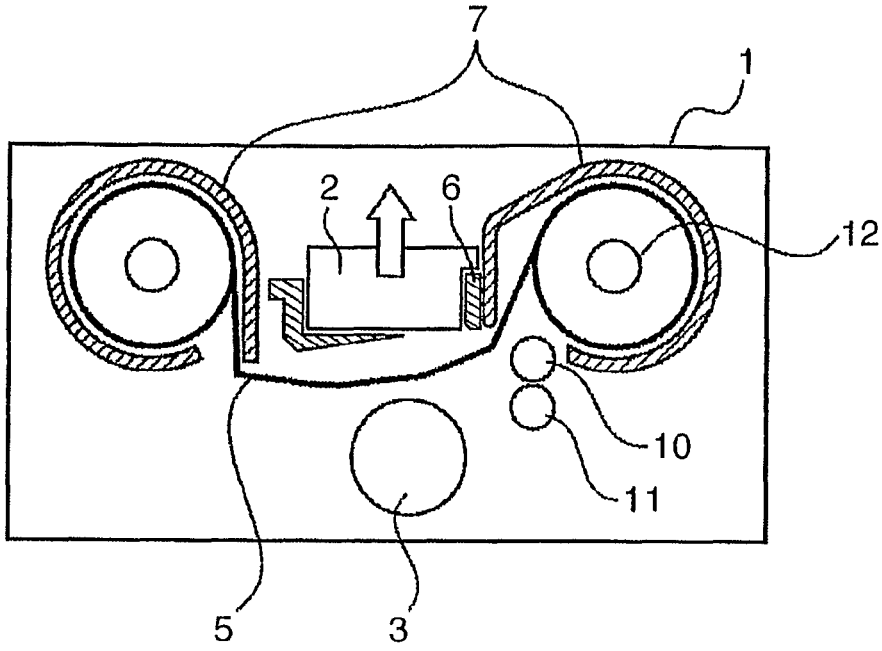
FIG. 3 PRIOR ART
FIG. 3 is a schematic cross-sectional view of a known printer apparatus with a retractable thermal head and illustrates a state where the thermal head is retracted.
Figure 4:
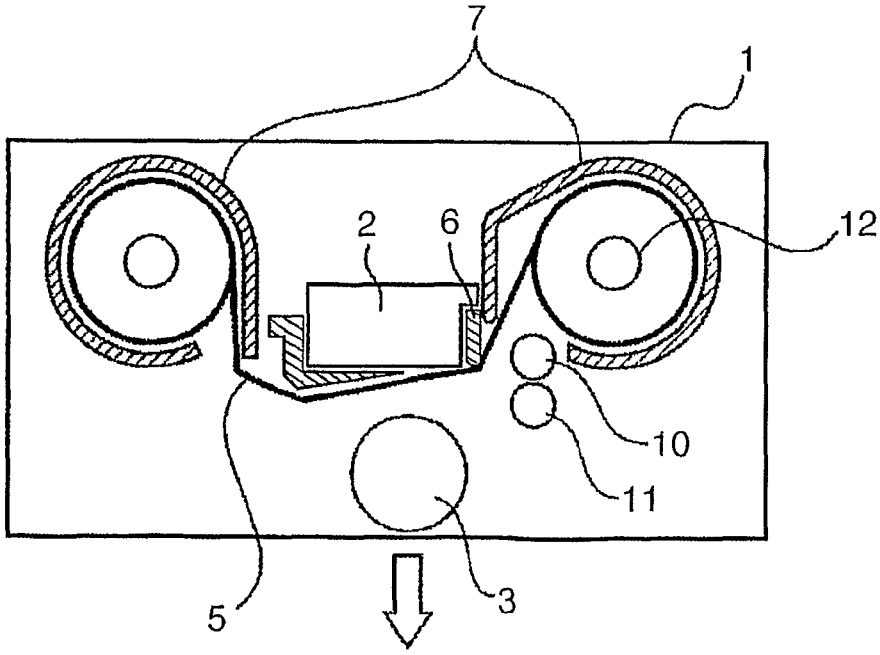
FIG. 4 PRIOR ART
FIG. 4 is a schematic cross-sectional view of a known printer apparatus with a retractable platen roller, illustrating a state where the platen roller is retracted.
Figure 5:
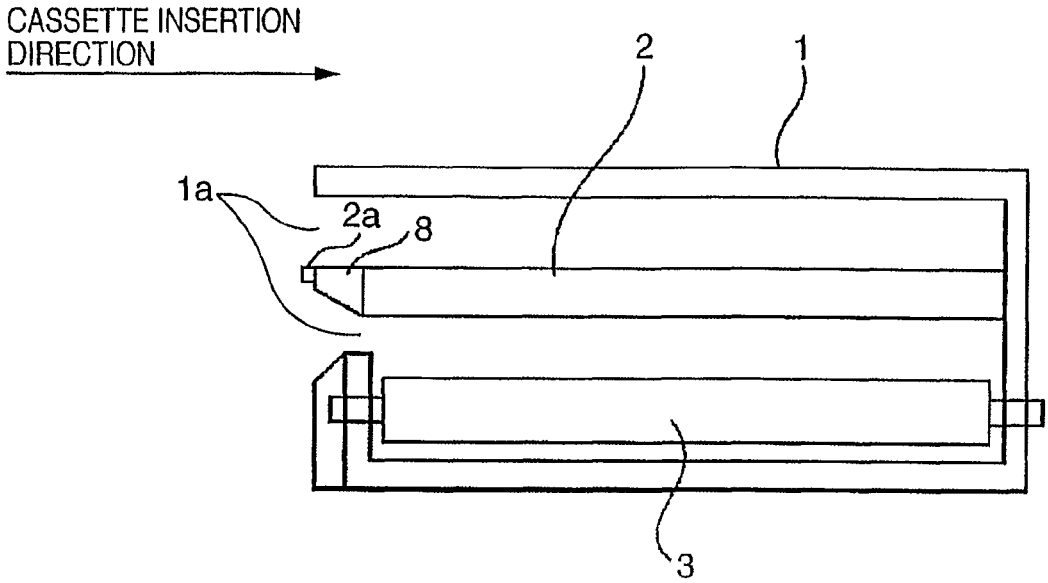
FIG. 5 PRIOR ART
FIG. 5 is a schematic cross-sectional view illustrating a printing mechanism of a known printer apparatus, in which a thermal head is fixed as a cantilever.
Figure 6:
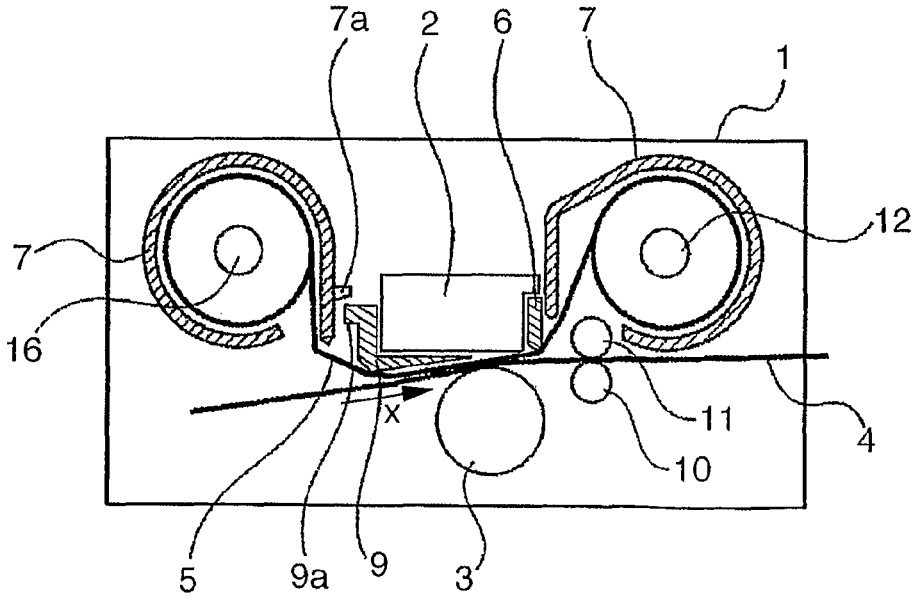
FIG. 6 is a schematic cross-sectional view illustrating an exemplary overall configuration of a printer apparatus and an ink ribbon cassette, according to a first exemplary embodiment of the present invention.

FIG. 6 is a schematic cross-sectional view of a main body of a printer apparatus 1 as viewed in an ink-sheet width direction.

In the main body of the printer apparatus 1 of the first exemplary embodiment, a thermal head 2 is provided as a heat source for thermal transfer printing. The thermal head 2 includes a circuit board on a surface thereof adjacent to a platen roller 3. A plurality of heating elements are linearly arranged on the circuit board of the thermal head 2. The platen roller 3 is movably positioned opposite the heating elements so as to be pressed against the heating elements. At the same time, the platen roller 3 is rotatably supported at its both ends. FIG. 6 illustrates a state where the platen roller 3 is pressed against the thermal head 2 during printing.

During printing, a recording sheet 4 and an ink sheet 5 are pressed against each other between the thermal head 2 and the platen roller 3. When the heating elements of the thermal head 2 generate heat, ink applied to the ink sheet 5 is transferred to the recording sheet 4. Every time the heating elements generate heat, one line of printing is performed. The recording sheet 4 is introduced into a nip between a roller pair including a grip roller 10 and a pinch roller 11. During printing, the recording sheet 4 is conveyed in a direction X of FIG. 6 by the rotation of the grip roller 10. Simultaneously, the ink sheet 5 pulled out of a supply bobbin 16 is conveyed in the direction X and taken up by a take-up bobbin 12 with a shaft that is rotated by an ink sheet take-up mechanism (not shown).

In synchronization with the conveyance of the recording sheet 4 and the ink sheet 5 in the direction X, the heating elements of the thermal head 2 repeatedly and selectively generate heat, allowing the linear images to be arranged in a recording sheet conveying direction to form a complete image on the recording sheet 4.

After the heat transfer is performed, the recording sheet 4 is conveyed by the roller pair, i.e., the grip roller 10 and the pinch roller 11, toward a paper ejecting unit. The ink sheet 5 is taken up by the take-up bobbin 12, and stored in a space of an ink ribbon cassette 7 adjacent to the take-up bobbin 12.

When a conveying path for the recording sheet 4 and a conveying path for the ink sheet 5 diverge in the middle, the recording sheet 4 and the ink sheet 5 sticking together are separated. To initiate the separation, a separating member 6 is provided adjacent to the ink sheet 5. The conveying path for the ink sheet 5 is bent at the separating member 6 to separate it from the conveying path for the recording sheet 4.

A lifting member 9 is secured to the thermal head 2. A lifting member contact portion 9*a*, which is part of the lifting member 9, is formed such that the outline thereof overlaps with the outline of a cassette contact portion 7*a* formed on the ink ribbon cassette 7. After completion of insertion of the ink ribbon cassette 7 into the main body of the printer apparatus 1 (see FIG. 6), the cassette contact portion 7*a* and the lifting member contact portion 9*a* are located in different areas in a direction orthogonal to the plane of FIG. 6, and are not in contact with each other.

Figure 7:
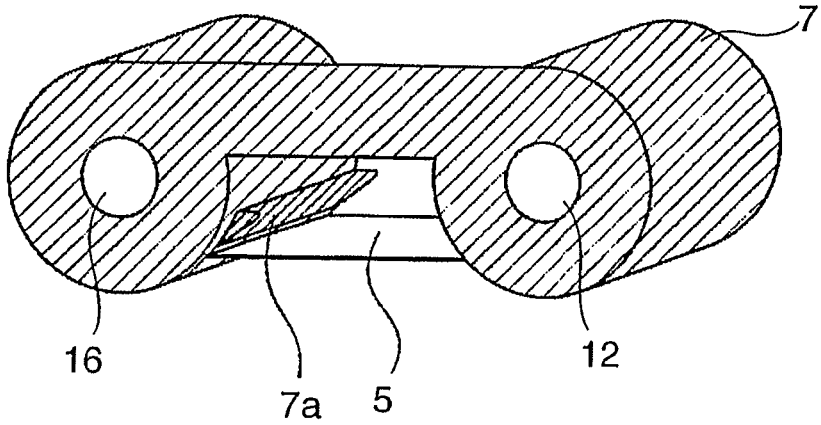
FIG. 7 is a schematic perspective view of the ink ribbon cassette according to the first exemplary embodiment.
Figure 8:
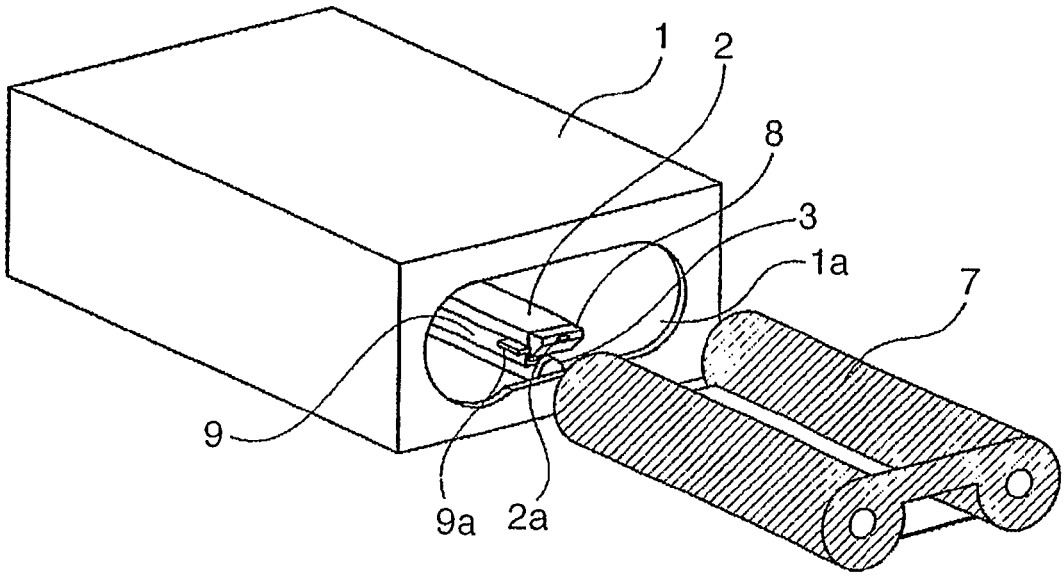
FIG. 8 is a schematic perspective view illustrating insertion or removal of the ink ribbon cassette into or from the printer apparatus, according to the first exemplary embodiment.

The perspective views of FIG. 7 and FIG. 8 illustrate the shapes of the cassette contact portion 7*a* and the lifting member contact portion 9*a* in further detail. As illustrated in FIG. 7, the cassette contact portion 7*a* is provided on a housing of the ink ribbon cassette 7. The cassette contact portion 7*a* is located between the supply bobbin 16 and the take-up bobbin 12 and near the ink sheet 5 exposed from the ink ribbon cassette 7. As illustrated in FIG. 8, the lifting member contact portion 9*a* is formed near an end of the thermal head 2 adjacent to an opening 1*a*. In other words, the lifting member contact portion 9*a* is located near a rear end of the thermal head 2, in a cassette insertion direction into which the ink ribbon cassette 7 is to be inserted.

Figure 10:
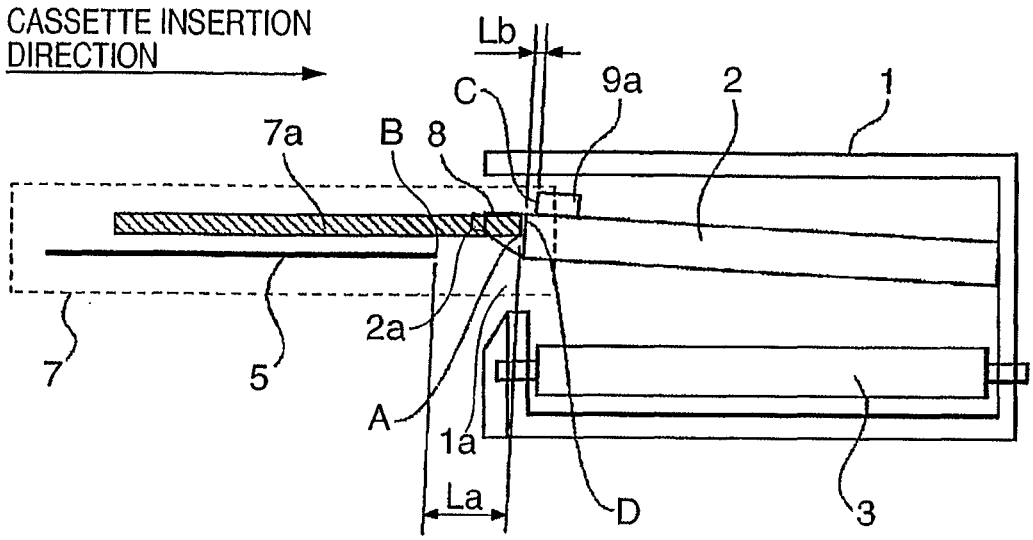
FIG. 10 is a schematic cross-sectional view of the printing mechanism of the printer apparatus and the ink ribbon cassette according to the first exemplary embodiment, illustrating a state immediately after the start of insertion of the ink ribbon cassette into the printer apparatus.

When the ink ribbon cassette 7 in the state of FIG. 8 is inserted into the printer apparatus 1, a leading end of the cassette contact portion 7*a* comes into contact with a rear end of the lifting member contact portion 9*a* in the cassette insertion direction, as per FIG. 10. The thermal head 2 is secured to the printer apparatus 1 as a cantilever. Therefore, when the cassette contact portion 7*a* comes into contact with the lifting member contact portion 9*a*, the end of the thermal head 2 adjacent to the opening 1*a* is lifted away from the platen roller 3. While the ink sheet 5 passes through the opening 1*a* and under the end of the thermal head 2 adjacent to the opening 1*a*, the cassette contact portion 7*a* and the lifting member contact portion 9*a* remain in contact with each other. Since this allows the thermal head 2 to be held at an upper position, sliding resistance between the ink sheet 5 and a guiding member 8 can be reduced. Moreover, since there is a sufficient distance between the thermal head 2 and the opening 1*a*, jamming of the ink sheet 5 can be avoided.

Next, positional relationships, in the cassette insertion direction, of the cassette contact portion 7*a*, the lifting member contact portion 9*a*, and the ink sheet 5 during cassette insertion and removal will be described in detail with reference to drawings.

Figure 9:
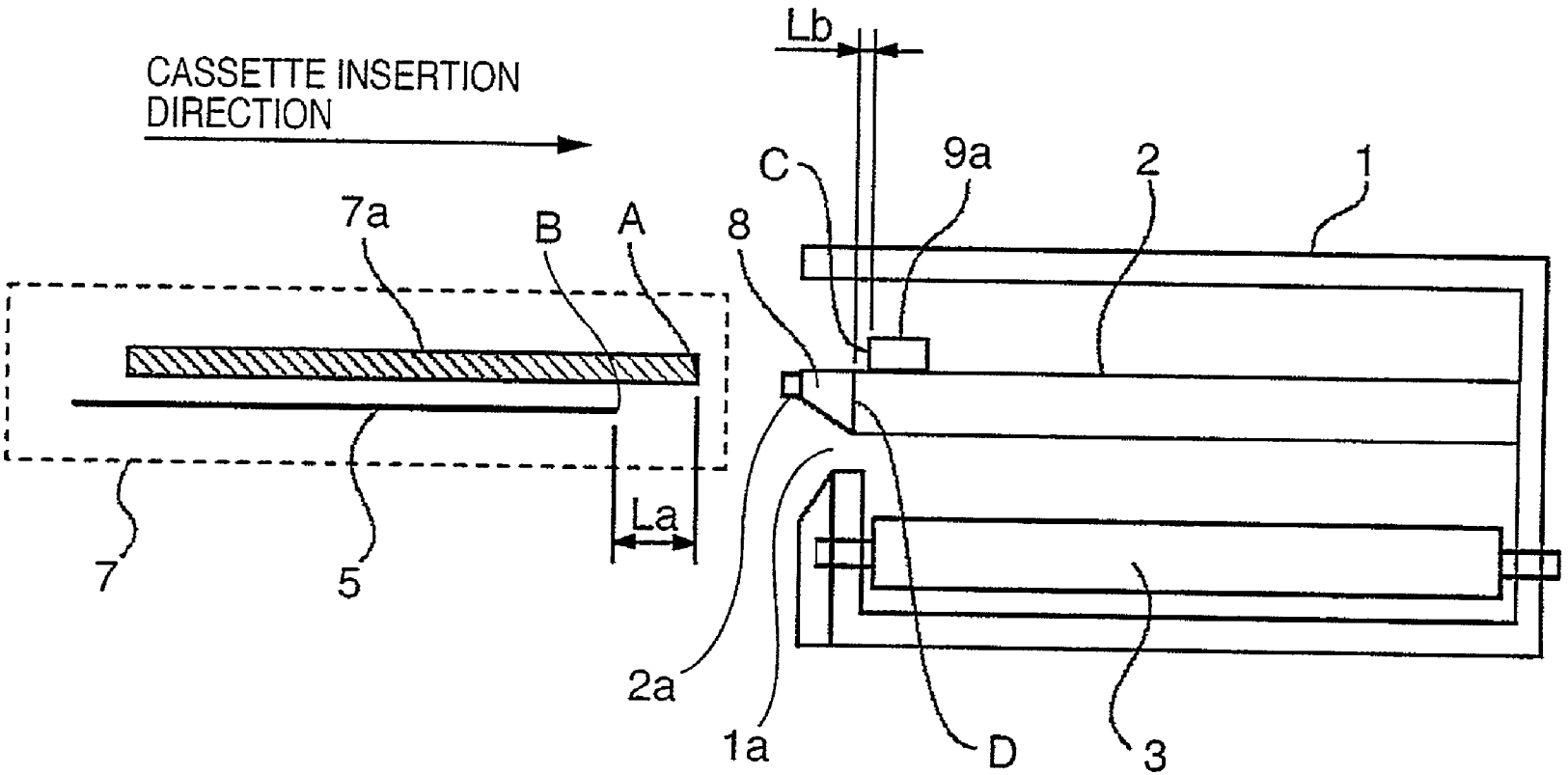
FIG. 9 is a schematic cross-sectional view of a printing mechanism of the printer apparatus and the ink ribbon cassette according to the first exemplary embodiment, illustrating a state where the ink ribbon cassette is not yet inserted into the printer apparatus.

FIG. 9 is a cross-sectional view taken along the cassette insertion direction, illustrating the printer apparatus 1 and the ink ribbon cassette 7, according to the present exemplary embodiment. FIG. 9 illustrates a state where the ink ribbon cassette 7 is not yet inserted into the printer apparatus 1. To simplify the illustration of the ink ribbon cassette 7, only the cassette contact portion 7*a* and the ink sheet 5 are illustrated in the cross-sectional views of FIGS. 9, 10, and 11.

Referring to FIG. 9, the platen roller 3 is secured to the printer apparatus 1 at both ends. At the same time, the thermal head 2 is secured to the printer apparatus 1 as a cantilever. The ink ribbon cassette 7 is inserted from a free end of the thermal head 2. Upon completion of insertion of the ink ribbon cassette 7, a lid (not shown) closes the opening 1*a*, allowing a supporting member 2*a* to be fitted into a hole provided, for the supporting member 2*a*, in the lid. The supporting member 2*a* enables accurate positioning of the thermal head 2, and supports the free end of the thermal head 2. Thus, the thermal head 2 is fixed at both ends like a simple beam, and can withstand contact pressure of the platen roller 3 during printing. Moreover, since the end of the thermal head 2 adjacent to the opening 1*a* is provided with the guiding member 8, the ink sheet 5 comes into contact with the guiding member 8, and can be guided into the printer apparatus 1 without causing jamming.

Figure 17:
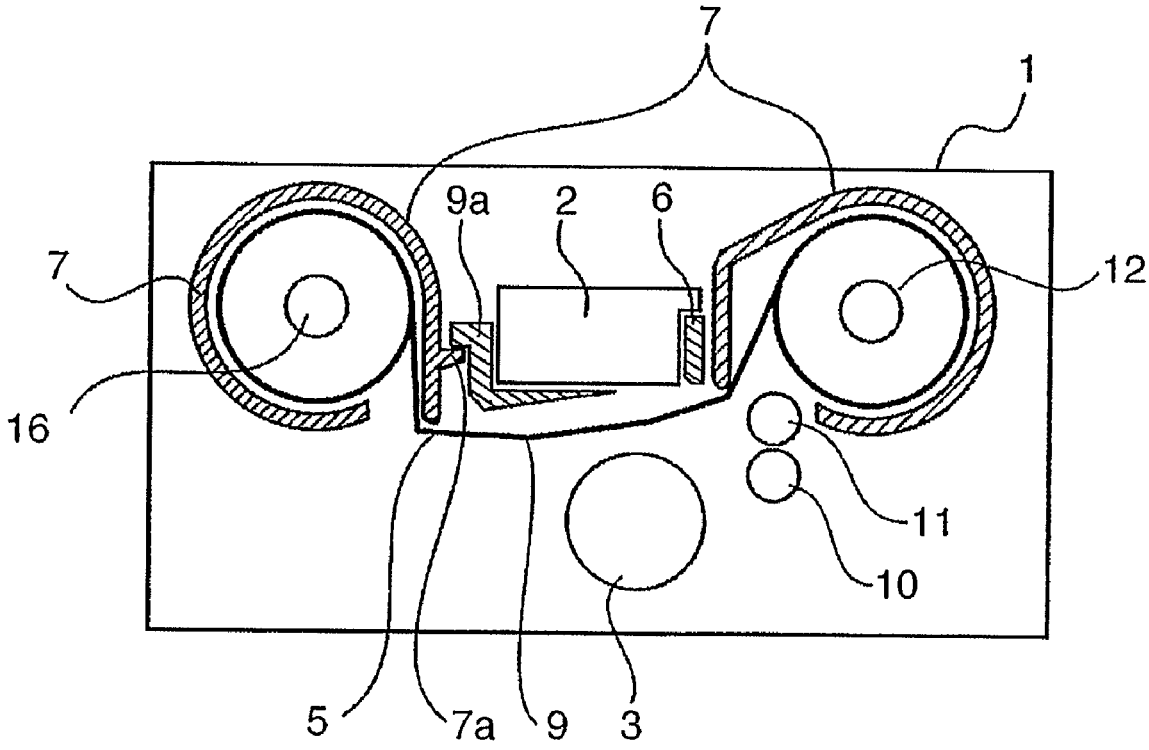
FIG. 17 is a schematic cross-sectional view of the printer apparatus according to the first exemplary embodiment illustrating a state where the ink ribbon cassette is inserted into the printer apparatus.

FIG. 10 is a cross-sectional view of the printer apparatus 1 and the ink ribbon cassette 7 according to the present exemplary embodiment, illustrating a state where the ink ribbon cassette 7 is inserted into the printer apparatus 1. FIG. 17 is a schematic cross-sectional view of the main body of the printer apparatus 1 during cassette insertion, as viewed in the cassette insertion direction.

Immediately after entry of the ink ribbon cassette 7 into the printer apparatus 1, the cassette contact portion 7*a* comes into contact with the lifting member contact portion 9*a*, causing the end of the thermal head 2 that is adjacent to the thermal head 2 to be lifted. As illustrated in FIG. 9 and FIG. 10, a leading end A of the cassette contact portion 7*a* is located in front of a leading end B of the ink sheet 5, in the cassette insertion direction. Given that the cassette contact portion 7*a* enters the printer apparatus 1 earlier than the ink sheet 5 to lift the thermal head 2, thus providing clearance for insertion of the ink sheet 5, it is possible to prevent the ink sheet 5 from coming into contact with the printer apparatus 1 and causing jamming thereby. A rear end C of the lifting member contact portion 9*a* is located in front of a rear end D of the thermal head 2, in the cassette insertion direction.

The relationship La>Lb is satisfied, wherein La denotes the distance between the leading end A of the cassette contact portion 7*a* and the leading end B of the ink sheet 5, and Lb denotes the distance between the rear end C of the lifting member contact portion 9*a* and the rear end D of the thermal head 2. Therefore, before the leading end B of the ink sheet 5 comes into contact with the rear end D of the thermal head 2, the leading end A of the cassette contact portion 7*a* comes into contact with the rear end C of the lifting member contact portion 9*a* to lift the thermal head 2. This prevents the leading end B of the ink sheet 5 from coming into contact with the rear end D of the thermal head 2, thus preventing jamming as a result.

Moreover, since the cassette contact portion 7*a* and the lifting member contact portion 9*a* lift the thermal head 2, the ink sheet 5 can be prevented from sliding over the guiding member 8 with strong resistance, and causing jamming as a result.

During cassette insertion where the ink ribbon cassette 7 is further inserted into the printer apparatus 1, the cassette contact portion 7*a* and the lifting member contact portion 9*a* slide and interfere with each other while being in contact with each other. Therefore, during cassette insertion, the rear end of the thermal head 2 is held at an upper position and separated from the ink sheet 5. Thus, during insertion of the ink ribbon cassette 7, the ink sheet 5 is prevented from coming into contact with the opening 1*a*, and causing jamming as a result.

According to the embodiment, the rear end D of the thermal head 2 is located at the position illustrated in FIG. 9 and FIG. 10. However, in the cassette insertion direction, the extreme rear end of the thermal head 2 including the guiding member 8 and the supporting member 2*a*, or in other words, the rear tip of the supporting member 2*a*, may be designated as "end D", whereupon the printer apparatus 1 is configured such that the relationship La>Lb is satisfied. This can prevent the ink sheet 5 from coming into contact with the guiding member 8 and the supporting member 2*a*, and causing jamming as a result.

Figure 11:
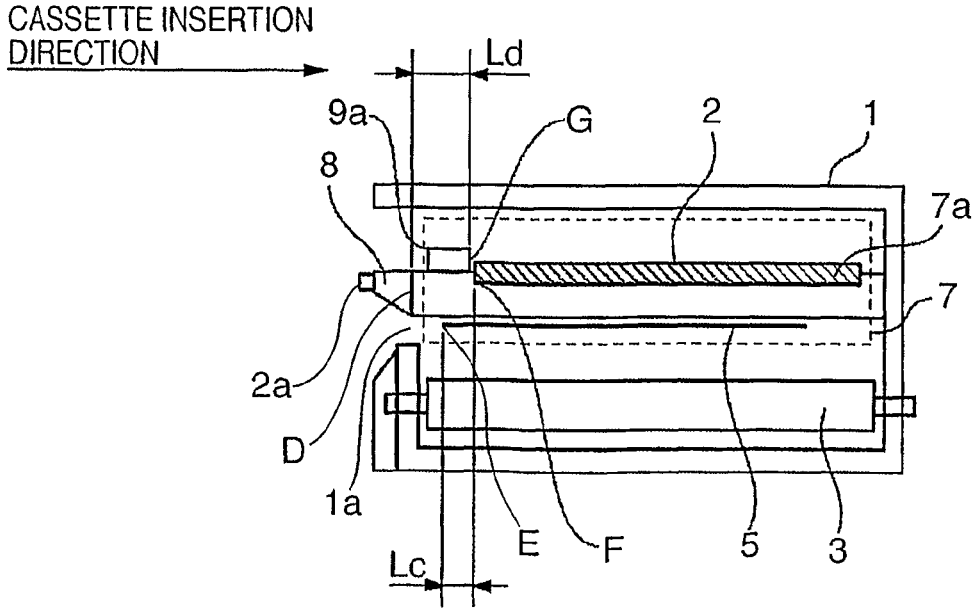
FIG. 11 is a schematic cross-sectional view of the printing mechanism of the printer apparatus and the ink ribbon cassette according to the first exemplary embodiment, illustrating a state after the completion of insertion of the ink ribbon cassette into the printer apparatus.

FIG. 11 is a cross-sectional view of the printer apparatus 1 and the ink ribbon cassette 7 according to the embodiment, illustrating a state where insertion of the ink ribbon cassette 7 into the printer apparatus 1 is completed.

After the completion of insertion of the ink ribbon cassette 7, a trailing end F of the cassette contact portion 7*a* is located in front of a front end G of the lifting member contact portion 9*a* in the cassette insertion direction. In other words, the cassette contact portion 7*a* and the lifting member contact portion 9*a* are not in contact with each other and no longer interfere with each other. Since the thermal head 2 is provided with an elastic member at one end secured to the printer apparatus 1, the thermal head 2 returns to a proper position where printing can be performed, by virtue of its own inherent elasticity.

It is necessary that the thermal head 2 return to the proper position before insertion of the ink ribbon cassette 7 into the printer apparatus 1 is completed. Therefore, the cassette contact portion 7*a* and the lifting member contact portion 9*a* are positioned such that they disengage from one another before completion of insertion of the ink ribbon cassette 7 into the printer apparatus 1, at a minimum.

The trailing end F of the cassette contact portion 7*a* is located in front of a trailing end E of the ink sheet 5 in the cassette insertion direction, while the front end G of the lifting member contact portion 9*a* is located in front of the rear end D of the thermal head 2. The relationship Lc<Ld is satisfied, wherein Lc denotes the distance between the trailing end F of the cassette contact portion 7*a* and the trailing end E of the ink sheet 5, and Ld denotes the distance between the front end G of the lifting member contact portion 9*a* and the rear end D of the thermal head 2. Therefore, before sliding of the cassette contact portion 7*a* and the lifting member contact portion 9*a* is completed, the ink sheet 5 passes over the rear end D of the thermal head 2, and the thermal head 2 and the guiding member 8 return to the normal position, avoiding jamming of the ink sheet 5.

When the ink ribbon cassette 7 in the state of FIG. 11 is to be removed from the printer apparatus 1, the cassette contact portion 7*a* and the lifting member contact portion 9*a* come into contact and interfere with each other before the ink sheet 5 passes by the end of the thermal head 2 adjacent to the opening 1*a*. This causes the thermal head 2 to be lifted from the ink sheet 5. The fact that the thermal head 2 moves away from the ink sheet 5 allows avoiding jamming of the ink sheet 5. During removal of the ink ribbon cassette 7 from the printer apparatus 1, the cassette contact portion 7*a* and the lifting member contact portion 9*a* continue sliding while being in contact with each other. The thermal head 2 is thus held at an upper position, spaced from the ink sheet 5, during removal of the ink ribbon cassette 7. The fact that the thermal head 2 is held above the ink sheet 5 until the ink sheet 5 passes over the end of the thermal head 2 allows the ink sheet 5 to avoid coming into contact with the thermal head 2, and thus, being scratched.

Second Exemplary Embodiment

A second exemplary embodiment will now be described. A cassette according to the second exemplary embodiment is an integral cassette formed by combining an ink ribbon cassette with a recording sheet cassette.

Figure 12:
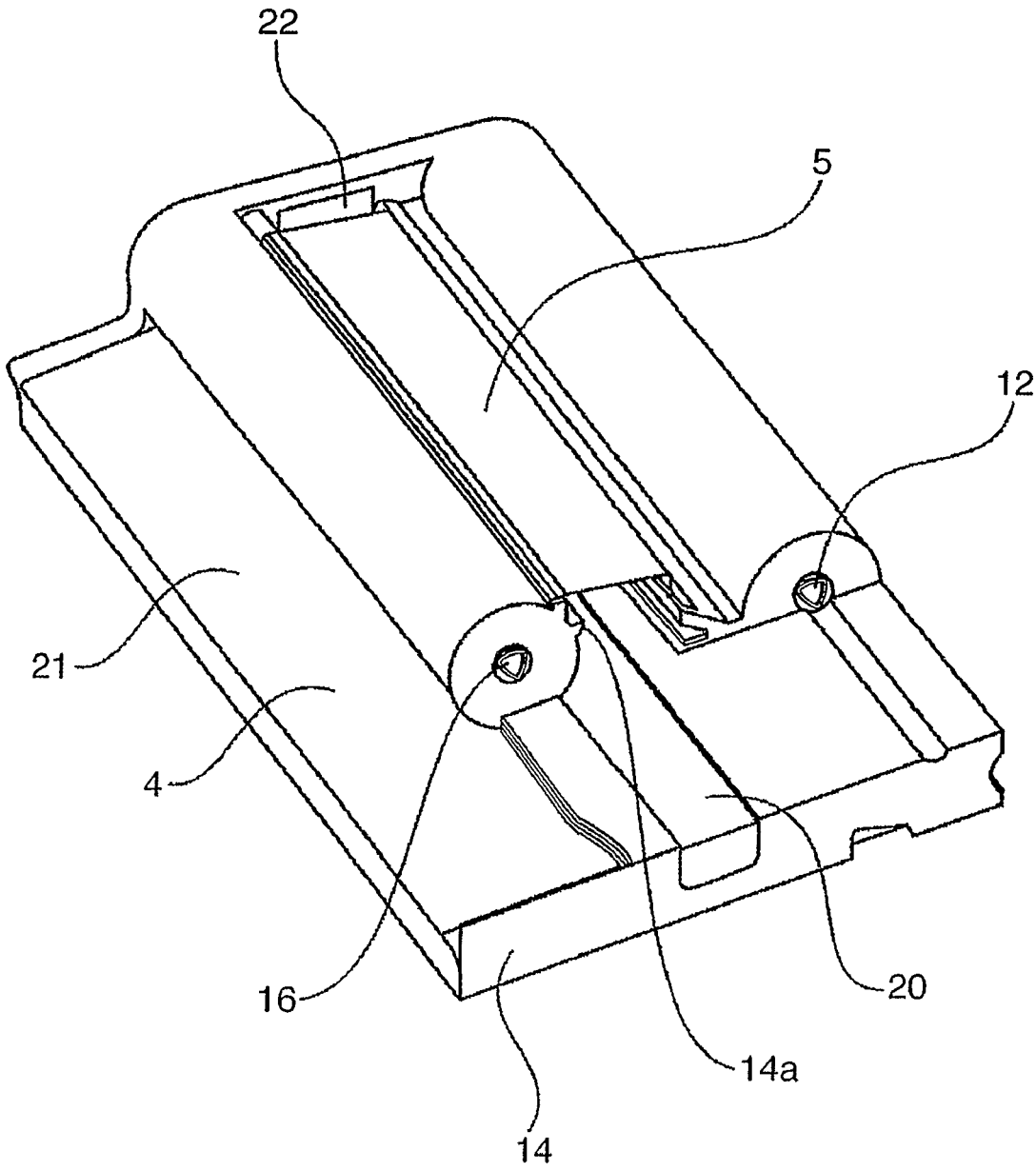
FIG. 12 is a schematic perspective view of an integral cassette according to a second exemplary embodiment of the present invention.
Figure 13:
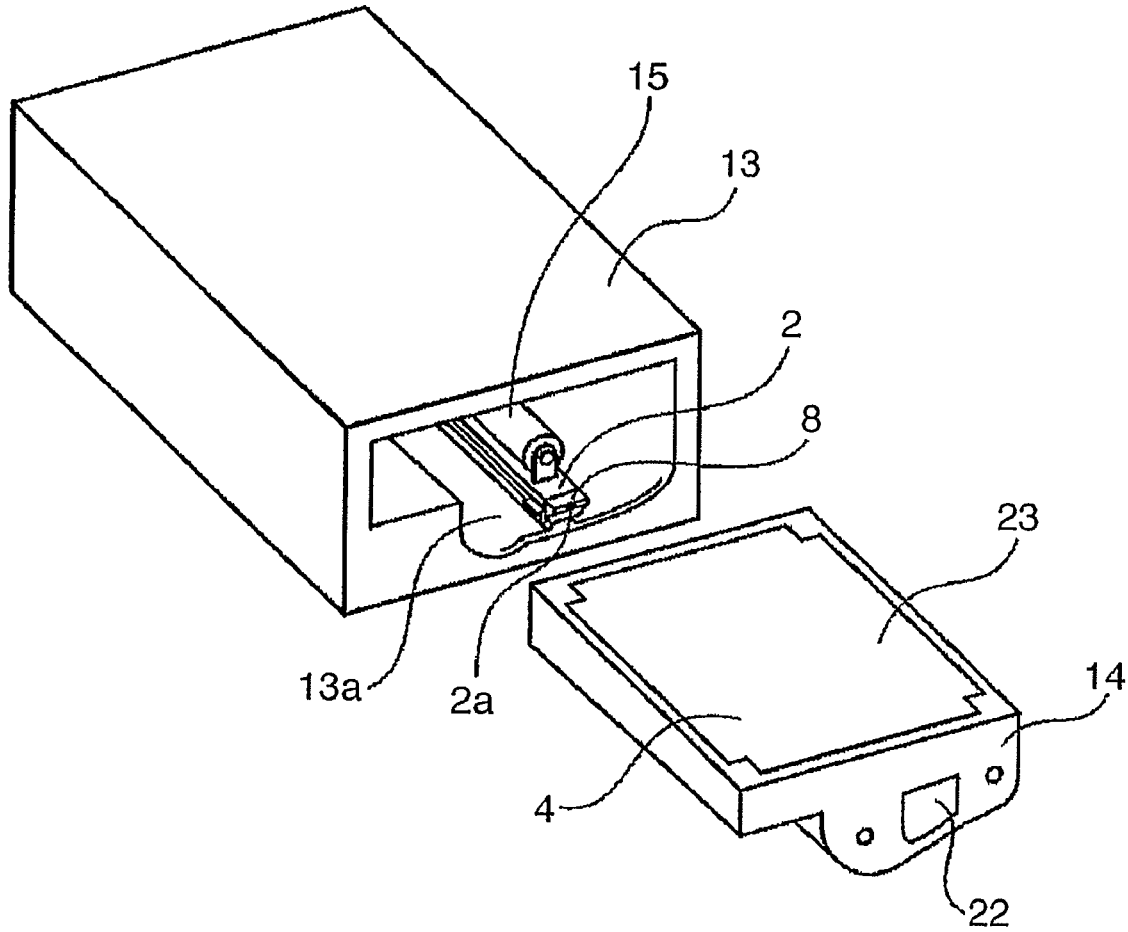
FIG. 13 is a schematic perspective view illustrating insertion or removal of the integral cassette into or from a printer apparatus according to the second exemplary embodiment.

FIG. 12 is a perspective view of an integral cassette 14 including a recording sheet storage unit 14*c* (see FIG. 14) according to the embodiment. FIG. 13 is a perspective view illustrating a printer apparatus 13 according to the embodiment, and the integral cassette 14 for the printer apparatus 13.

As illustrated in FIG. 12, the orientation of a recording sheet 4 stored in the integral cassette 14 differs by 90 degrees from the orientation of an ink sheet 5, for convenience of a recording sheet conveying mechanism of the printer apparatus 13. Therefore, the exterior of the integral cassette 14 is sized such that the recording sheet storage unit 14*c* (see FIG. 14) is greater in length in the axial direction of the ink sheet 5 than an ink sheet storage unit.

In the printer apparatus 13 and the integral cassette 14 according to the embodiment, components having the same functions as those in the first embodiment are given the same reference numerals. The integral cassette 14 is provided with a cassette contact portion 14*a*, as per FIG. 14, similar to the cassette contact portion 7*a* of the first embodiment. A lifting member 9, as per FIG. 18, attached to a thermal head 2, is provided with a lifting member contact portion 9*a* that is similar to the lifting member contact portion 9*a*, according to the first embodiment. The lifting member contact portion 9*a* according to the embodiment is formed near an opening 13*a*, as per FIG. 13.

Referring to FIG. 12, an opening 20 is provided for driving the ejection of the recording sheet 4. A recording sheet conveying mechanism 15, including a paper feed roller 17 in FIG. 14, drives the ejection of the recording sheet 4 through the opening 20. The recording sheet 4 is thus ejected from an opening 21 provided for the ejection of the recording sheet 4.

As illustrated in FIG. 13, the main body of the printer apparatus 13 is provided with the opening 13*a* for accommodating the integral cassette 14. The recording sheet conveying mechanism 15 is positioned on the thermal head 2. The recording sheet conveying mechanism 15 includes the paper feed roller 17, as per FIG. 14, for conveying the recording sheet 4 from the integral cassette 14 to the main body of the printer apparatus 13 during printing when the integral cassette 14 is placed inside the printer apparatus 13. The thermal head 2 and the recording sheet conveying mechanism 15 are secured to the printer apparatus 13 as a cantilever.

Figure 16:
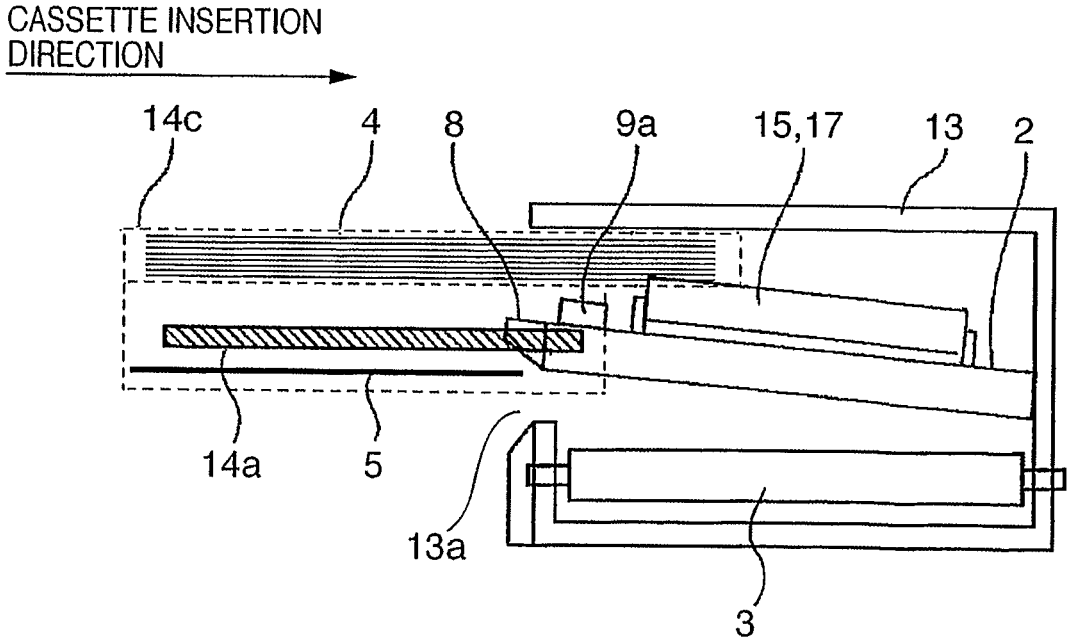
FIG. 16 is a schematic cross-sectional view of the printing mechanism of the printer apparatus and the integral cassette according to the second exemplary embodiment, illustrating a state where an ink sheet storage unit also enters the main body of the printer apparatus in the middle of cassette insertion.

When the integral cassette 14 is inserted into the printer apparatus 13, the cassette contact portion 14*a*, as per FIG. 16, comes into contact with the lifting member contact portion 9*a* and causes an end of the recording sheet conveying mechanism 15 adjacent to the opening 13*a* to be lifted. While the ink sheet 5 passes through the opening 13*a* and under the end of the thermal head 2 adjacent to the opening 13*a*, the cassette contact portion 14*a* remains in contact with the lifting member contact portion 9*a*. Thus, the thermal head 2 is held above the ink sheet 5, allowing a reduction in sliding resistance between the ink sheet 5 and a guiding member 8. The fact that there is a sufficient distance between the thermal head 2 and the opening 13*a* allows avoiding jamming the ink sheet 5.

After insertion of the integral cassette 14 into the printer apparatus 13 is completed, the cassette contact portion 14*a* and the lifting member contact portion 9*a* are no longer in contact with each other. The thermal head 2 returns to a printing position by virtue of its own inherent elasticity. A supporting member 2*a* for the thermal head 2 passes through an opening 22 of the integral cassette 14 and is fitted into a hole for the supporting member 2*a*, the hole being provided in a lid (not shown) for the opening 13*a*, allowing accurate positioning of the thermal head 2, which is supported at both ends like a simple beam, and thus can withstand contact pressure of a platen roller 3 during printing, as per FIG. 18. An opening 23 is provided for applying pressure to the recording sheet 4.

In the printer apparatus 13, according to the embodiment, the recording sheets 4 and the ink sheet 5 can be stored in a single cassette, i.e., an integral cassette 14, avoiding the necessity of inserting the recording sheet cassette and the ink ribbon cassette individually into the printer apparatus 13, thus making the system more convenient for users. The fact that the recording sheet conveying mechanism 15 is integral with the thermal head 2 allows reducing the overall size of the printer apparatus 13.

Figure 18:
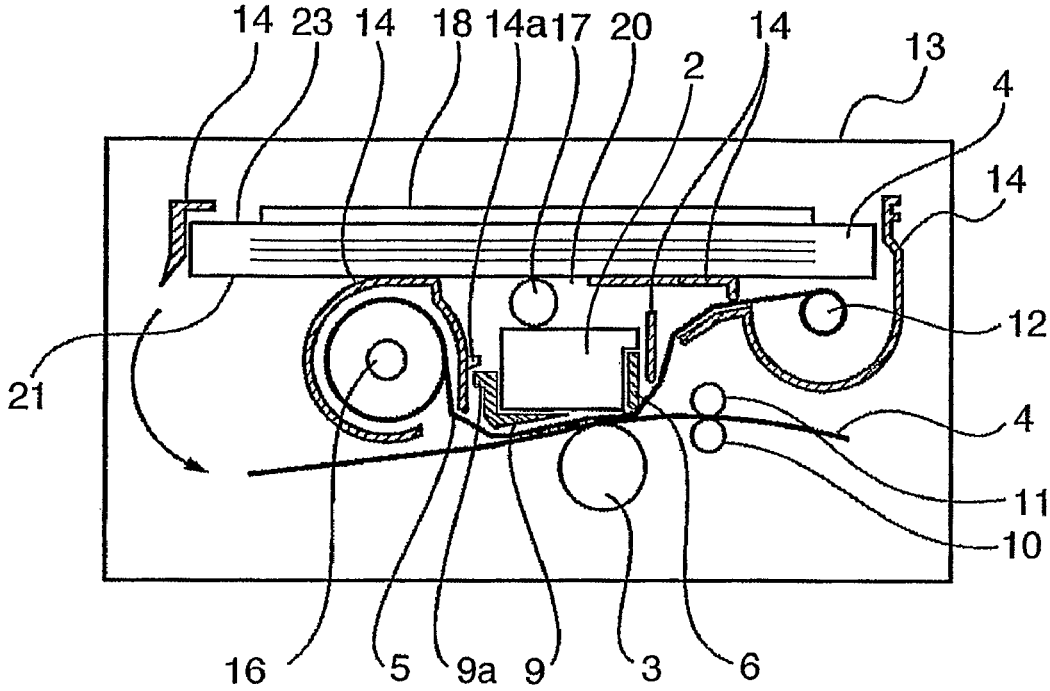
FIG. 18 is a schematic cross-sectional view of the printer apparatus of the second exemplary embodiment during printing.

FIG. 18 is a cross-sectional view of the printer apparatus 13 during printing.

Referring to FIG. 18, a pressure plate 18 applies pressure through the opening 23 to the recording sheets 4 in a direction toward the paper feed roller 17, which is provided in the recording sheet conveying mechanism 15. The recording sheets 4 are ejected outside the integral cassette 14 through the opening 21, by the paper feed roller 17. A recording sheet 4 ejected from the integral cassette 14 moves in the direction of the arrow shown in FIG. 18. An image is then printed on the recording sheet 4 by the thermal head 2. The operations of a roller pair, i.e., a grip roller 10 and a pinch roller 11, a supply bobbin 16, and a take-up bobbin 12 are not described here, as they are similar to those according to the first embodiment.

Figure 19:
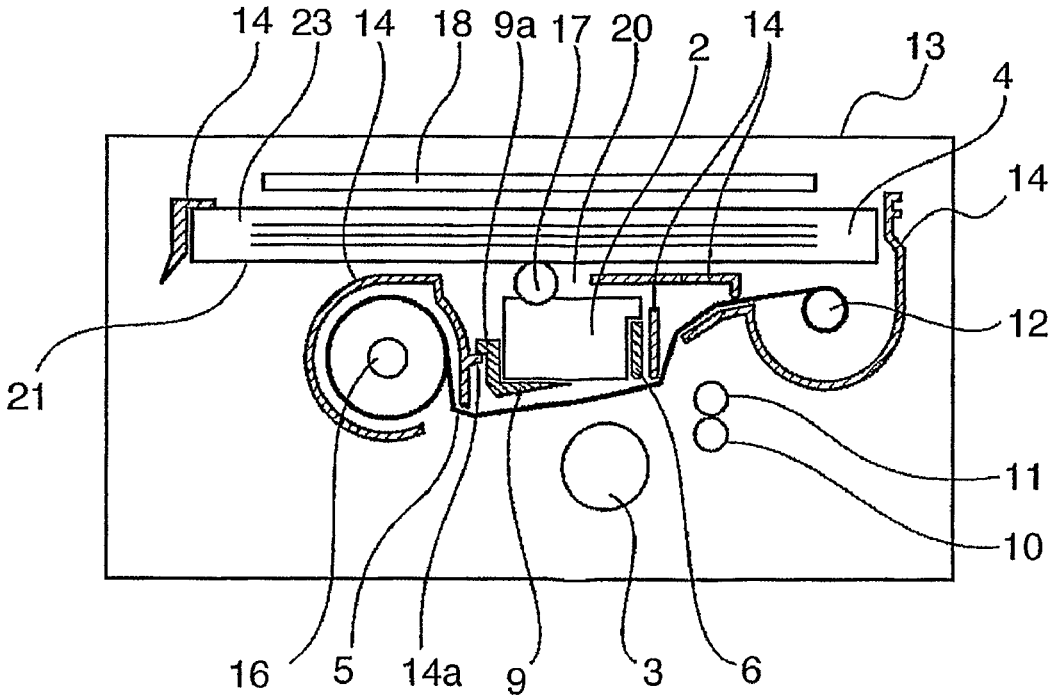
FIG. 19 is a schematic cross-sectional view of the printer apparatus according to the second exemplary embodiment, illustrating a state where the ink ribbon cassette is inserted into the printer apparatus.

FIG. 19 is a schematic cross-sectional view of the printer apparatus 13 during insertion of the integral cassette 14 thereinto.

During insertion of the integral cassette 14 into the printer apparatus 13, the pressure plate 18 is fixed at a predetermined position, and does not apply pressure to the recording sheets 4. At the same time, the cassette contact portion 14*a* comes into contact with the lifting member contact portion 9*a*, causing the thermal head 2 and the paper feed roller 17 to be lifted toward the recording sheet storage unit 14*c* through the opening 20, which is provided for paper feeding, as per FIG. 16.

During cassette insertion, where the integral cassette 14 is further inserted into the printer apparatus 13, the cassette contact portion 14*a* and the lifting member contact portion 9*a* continuously slide relative to each other, and an end of the thermal head 2 is held at an upper position, avoiding jamming by preventing the ink sheet 5 from coming into contact with the opening 13*a* and the thermal head 2 during insertion of the integral cassette 14.

Next, positional relationships, in the cassette insertion direction, of the cassette contact portion 14*a*, the lifting member contact portion 9*a*, and the ink sheet 5 during cassette insertion and removal, will be described in detail with reference to drawings.

Similar to the first exemplary embodiment, when the integral cassette 14 in the state of FIG. 13 is inserted into the printer apparatus 13, a leading end of the cassette contact portion 14*a* in the cassette insertion direction comes into contact with a rear end of the lifting member contact portion 9*a* in the cassette insertion direction, as per FIG. 16, causing the thermal head 2 to be lifted away from the platen roller 3. According to the embodiment, the cassette contact portion 14*a* causes the thermal head 2 to move upward. However, the thermal head 2 does not necessarily have to be moved upward, but can be moved in any direction which allows the thermal head 2 to separate from the ink sheet 5. The same also applies to the first embodiment.

While the ink sheet 5 passes through the opening 13*a* and under the end of the thermal head 2 adjacent to the opening 13*a*, the cassette contact portion 14*a* and the lifting member contact portion 9*a* remain in contact with each other, allowing the thermal head 2 to be held at an upper position, facilitating a reduction in sliding resistance between the ink sheet 5 and the guiding member 8. Jamming of the ink sheet 5 may also be avoided because there is a sufficient distance between the thermal head 2 and the opening 13*a*.

Next, positional relationships, in the cassette insertion direction, of the cassette contact portion 14*a*, the lifting member contact portion 9*a*, and the recording sheet conveying mechanism 15, during cassette insertion and removal, will be described with reference to cross-sectional views.

Figure 14:
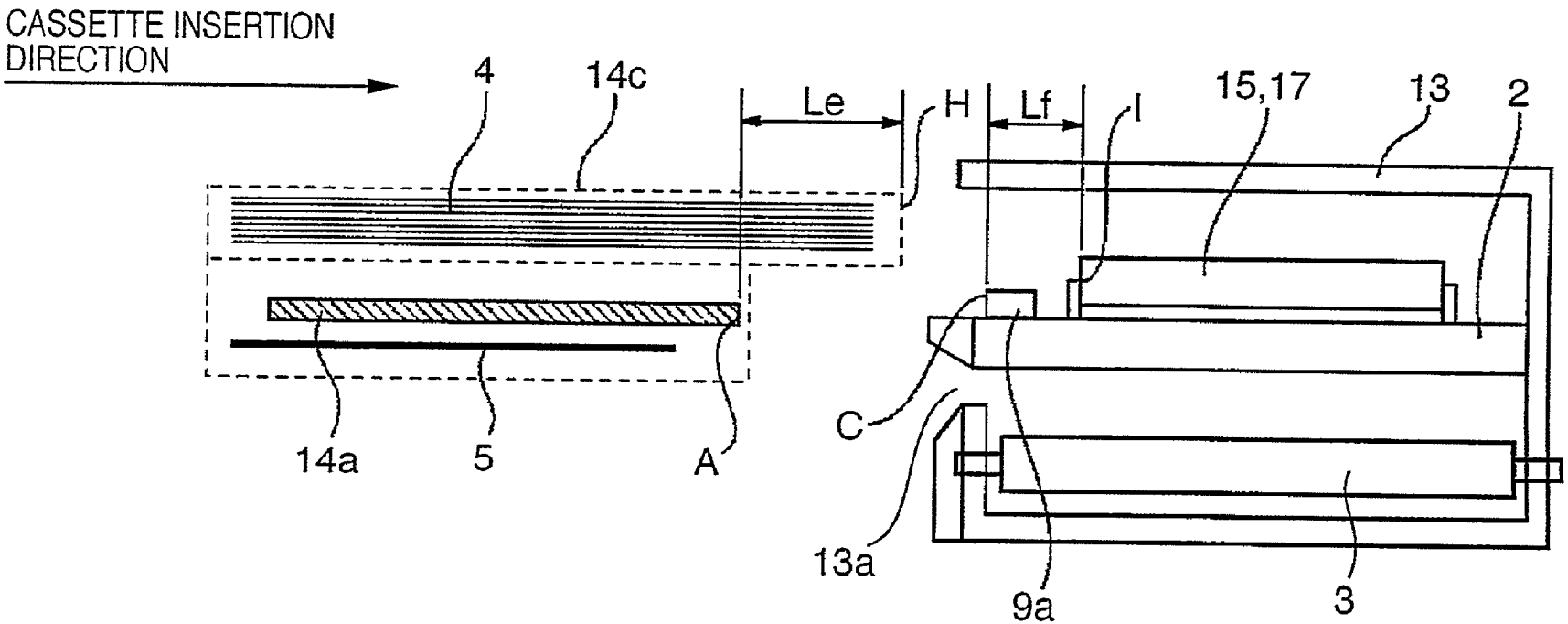
FIG. 14 is a schematic cross-sectional view of a printing mechanism of the printer apparatus and the integral cassette according to the second exemplary embodiment, illustrating a state where the integral cassette is not yet inserted into the printer apparatus.

FIG. 14 is a cross-sectional view of the printer apparatus 13 and the integral cassette 14 according to the second embodiment. FIG. 14 illustrates a state where the integral cassette 14 is not yet inserted into the printer apparatus 13. To simplify the illustration of the integral cassette 14, only the cassette contact portion 14*a*, the recording sheets 4, and the ink sheet 5 are illustrated in the cross-sectional views of FIGS. 14, 15, and 16.

Figure 15:
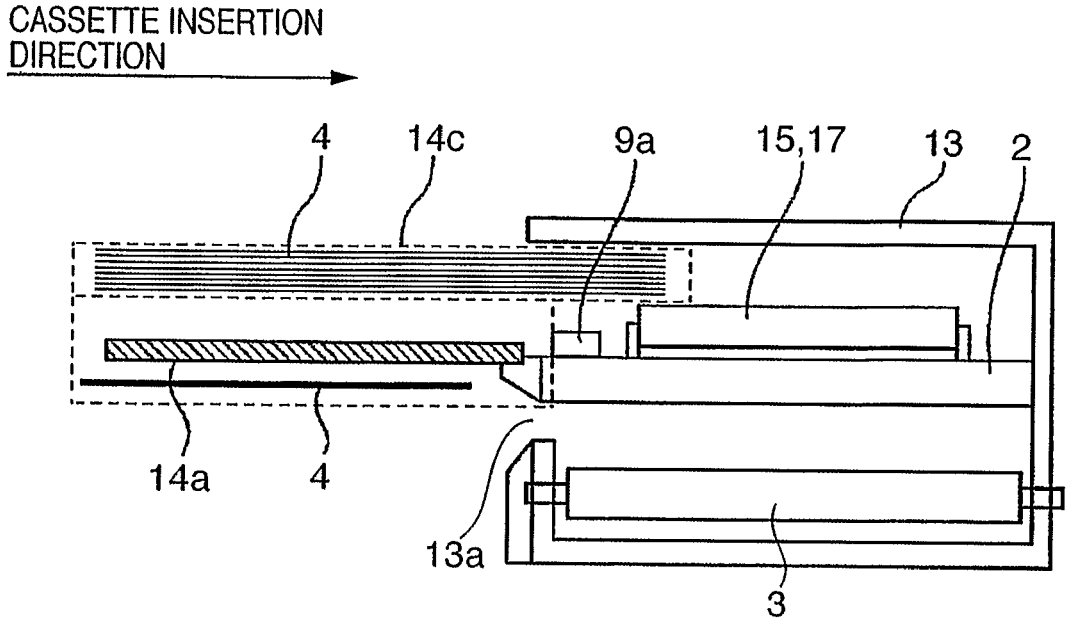
FIG. 15 is a schematic cross-sectional view of the printing mechanism of the printer apparatus and the integral cassette according to the second exemplary embodiment, illustrating a state where only a recording sheet storage unit enters the main body of the printer apparatus immediately after the start of cassette insertion.

FIG. 15 is a cross-sectional view of the printer apparatus 13 and the integral cassette 14, illustrating a state immediately after the start of insertion of the integral cassette 14 into the printer apparatus 13.

Immediately after entry of the integral cassette 14 into the printer apparatus 13, the recording sheet storage unit 14*c* and the recording sheets 4 stored therein are inserted into a space between the recording sheet conveying mechanism 15 and an upper portion of the printer apparatus 13.

When the integral cassette 14 is further inserted into the printer apparatus 13 as illustrated in FIG. 16, the cassette contact portion 14*a* comes into contact with the lifting member contact portion 9*a*, causing the end of the thermal head 2 adjacent to the opening 13*a* to be lifted. When the thermal head 2 is lifted, the recording sheet conveying mechanism 15 mounted thereon is also lifted, slightly narrowing an insertion path for the recording sheet storage unit 14*c* and the recording sheets 4.

As illustrated in FIG. 14, a leading end A of the cassette contact portion 14*a* is located behind a leading end H of the recording sheet storage unit 14*c* in the cassette insertion direction.

The relationship Le>Lf is satisfied, wherein Le denotes the distance between the leading end A and the leading end H, and Lf denotes the distance between a rear end C of the lifting member contact portion 9*a* and a rear end I of the recording sheet conveying mechanism 15 in the cassette insertion direction.

Given the positional relationships described above, when the recording sheet conveying mechanism 15 is lifted by cassette insertion, as per FIG. 16, the insertion path for the recording sheet storage unit 14*c* and the recording sheets 4 is slightly narrowed. However, at this point, the leading end of the recording sheet storage unit 14*c* and the recording sheets 4 have already passed over the rear end of the recording sheet conveying mechanism 15, in the cassette insertion direction. Therefore, it is possible to prevent the rear end of the lifted recording sheet conveying mechanism 15 from coming into contact with the leading end of the recording sheet storage unit 14*c* and the recording sheets 4, and thus blocking the cassette insertion.

When the integral cassette 14 is further inserted, the ink sheet 5 passes under the thermal head 2, and moves further into the printer apparatus 13. Other operations that follow are similar to those of the first embodiment.

The shapes of the cassette contact portion 7*a* (14*a*) and the lifting member 9 for the thermal head 2 are not limited according to the embodiments. The cassette contact portion 7*a* (14*a*) and the lifting member 9 for the thermal head 2 may have any shape which allows the thermal head 2 to move away from the ink sheet 5, during cassette insertion and removal.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-071126 filed Mar. 15, 2006, which is hereby incorporated by reference herein in its entirety.

The invention claimed is:

1. A cassette, adapted to be inserted into, and removed from, a printer capable of transferring ink from an ink sheet to a recording sheet with a thermal head unit, wherein the cassette is configured to be inserted into the printer in a longitudinal direction of the thermal head unit, comprising:

a first bobbin around which the ink sheet is wound;

a second bobbin for taking up the ink sheet drawn from the first bobbin; and a housing configured to support the first bobbin and the second bobbin;

wherein the housing is provided with a contact portion which comes into contact with a contact member for the thermal head unit when the cassette is inserted into the printer, thereby causing the thermal head unit to move away from the ink sheet, and wherein the housing further comprises a recording sheet storage unit configured to accommodated recording sheets, and a leading end of the recording sheet storage unit, in an insertion direction in which the cassette is inserted into the printer, is located in front of a leading end of the contact portion in the insertion direction.

2. The cassette according to claim 1, wherein the contact portion is located between the first bobbin and the second bobbin.

3. The cassette according to claim 1, wherein a leading end of the contact portion, in an insertion direction in which the cassette is inserted into the printer, is located in front of a leading end of the ink sheet in the insertion direction.

4. The cassette according to claim 1, wherein the contact portion is provided in such a way that a distance between a leading end of the ink sheet, in the insertion direction in which the cassette is inserted into the printer, and a leading end of the contact portion in the insertion direction, is greater than a distance between a rear end of the contact member for the thermal head unit in the insertion direction, and a rear end of the thermal head unit in the insertion direction.

5. The cassette according to claim 1, wherein the contact portion is provided so as not to be in contact with the contact member for the thermal head unit when insertion of the cassette into the printer is completed.

6. The cassette according to claim 1, wherein the cassette is attached to the printer such that the thermal head unit is located between the first bobbin and the second bobbin.

7. The cassette according to claim 1, wherein the recording sheet storage unit is configured to support the first bobbin and the second bobbin, wherein the cassette is attached to the printer such that the thermal head unit is located between the ink sheet that is drawn from the first bobbin, and the recording sheet storage unit.

* * * * *